US011193251B2

(12) United States Patent
Delorme

(10) Patent No.: US 11,193,251 B2
(45) **Date of Patent: *Dec. 7, 2021**

(54) INSULATED SLAB-ON-GRADE FOUNDATION SYSTEM

(71) Applicant: INNOVATION ISO-SLAB INC., Sainte-Thérèse (CA)

(72) Inventor: Benoit Delorme, Mirabel (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/583,557

(22) Filed: Sep. 26, 2019

(65) Prior Publication Data

US 2020/0024819 A1 Jan. 23, 2020

Related U.S. Application Data

(62) Division of application No. 15/869,795, filed on Jan. 12, 2018, now Pat. No. 10,428,484.

(51) Int. Cl.
*E02D 27/02* (2006.01)

(52) U.S. Cl.
CPC ..... *E02D 27/02* (2013.01); *E02D 2250/0023* (2013.01); *E02D 2300/0046* (2013.01)

(58) Field of Classification Search
CPC ..... E02D 27/02; E02D 2250/0023; E02D 2300/0046
See application file for complete search history.

(56) References Cited

U.S. PATENT DOCUMENTS 3,561,175 A * 2/1971 Best ..... E02D 27/02 52/169.11
3,956,859 A * 5/1976 Ingestrom ..... E02D 27/02 52/169.11
4,335,548 A * 6/1982 Rehbein ..... E02D 31/00 52/169.11
5,934,036 A * 8/1999 Gallagher, Jr. ..... E04B 5/43 249/188
8,656,653 B1 * 2/2014 O'Malia ..... E04B 1/0007 52/169.11
9,074,336 B2 * 7/2015 Lewis ..... E02D 27/00
10,428,484 B2 * 10/2019 Delorme ..... E02D 27/02
2007/0068095 A1 * 3/2007 Linse ..... E02D 27/01 52/169.12
2009/0255199 A1 * 10/2009 Lonsdale ..... E02D 27/02 52/292
2014/0182221 A1 * 7/2014 Hicks ..... E02D 31/00 52/169.11

(Continued)

FOREIGN PATENT DOCUMENTS

CA 2888752 A1 * 10/2016 ..... E01C 3/006
DE 29709300 U1 * 2/1998 ..... E02D 27/01
EP 3059350 A1 * 8/2016 ..... E02D 27/013

OTHER PUBLICATIONS

EPO Search Report and Written Opinion for related Application No. 18206280.2 (7 pages), (dated 2019).*

*Primary Examiner* — Rodney Mintz

(57) ABSTRACT

A foundation system (1) and method of installing the foundation system. The system including plurality of modular slabs (3, 3A, 3B) mountable onto a gravel layer (2); and at least one horizontal isolating slab (5A, 5B, 5C) and a vertical edge portion (4) positioned with respect to the modular slabs (3A, 3A, 3B) for creating a receptacle wherein concrete is poured thereon.

13 Claims, 4 Drawing Sheets

(56) References Cited

U.S. PATENT DOCUMENTS

| | | | | |
|---|---|---|---|---|
| 2014/0260022 | A1* | 9/2014 | Lewis | E02D 27/00 52/294 |
| 2017/0022682 | A1* | 1/2017 | Hicks | E02D 31/00 |
| 2018/0127944 | A1* | 5/2018 | Hicks | E02D 27/02 |
| 2019/0218741 | A1* | 7/2019 | Delorme | E02D 27/02 |

* cited by examiner

INSULATED SLAB-ON-GRADE FOUNDATION SYSTEM

CROSS REFERENCE TO RELATED APPLICATION

This application is a divisional application of U.S. patent application Ser. No. 15/869,795 now pending filed on Jan. 12, 2018.

FIELD OF THE INVENTION

The present invention relates to a system of insulated slab-on-grade foundation system to protect building shallow foundations and is more particularly concerned with method of installing such system.

BACKGROUND OF THE INVENTION

It is well known in the art to use insulated slab-on-grade foundation system to protect shallow foundations. More particularly, the invention pertains to an insulated slab-on-grade foundation system and method for shallow foundation. The typical isolation system for foundation does not adjust and is fixed or does not adapt to the different dimension of shallow foundations.

Accordingly, there is a need for an improved insulated slab-on-grade foundation system with a simple configuration.

SUMMARY OF THE INVENTION

It is therefore a general object of the present invention to provide an improved insulated slab-on-grade foundation system.

An advantage of embodiments of the present invention is that the insulated slab-on-grade foundation system may have the capacity to adapt to any size projects such as building, housing, garage and other construction project.

Another advantage of embodiments of the present invention is that the insulated slab-on-grade foundation system may be more efficient than known systems.

A further advantage of embodiments of the present invention is that it may be made mostly of EPS (expanded polystyrene material), it may be pre-shaped, it may not be molded and therefore may be less expensive.

Still another advantage of embodiments of the present invention is that the isolated frost protection made of said EPS may be pre-shaped in one part or more likely in two different parts so as to allow an easy installation process.

Another advantage of embodiments of the present invention is that the installation process may become easier because of the dovetail pre-form can fit together.

Still a further advantage of embodiments the present invention is that the isolated frost protection may be made of EPS in two smaller parts as compared to one large piece and so easier to operate.

According to a first aspect of the present invention, there is provided that the isolated frost protection stays in place after the pouring of the concrete because of the locking mechanism provided by the dovetail.

In a second aspect of the present invention, there is provided an isolated frost protection system for saving time, energy, and relatively less costly and adaptable to any type of construction.

Other objects and advantages of the present invention will become apparent from a careful reading of the detailed non-restrictive description of specific embodiments thereof provided herein and given by way of example only, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF ILLUSTRATIVE EMBODIMENTS

With reference to the annexed drawings the preferred embodiments of the present invention will be herein described for indicative purpose and by no means as of limitation.

Figure 1:
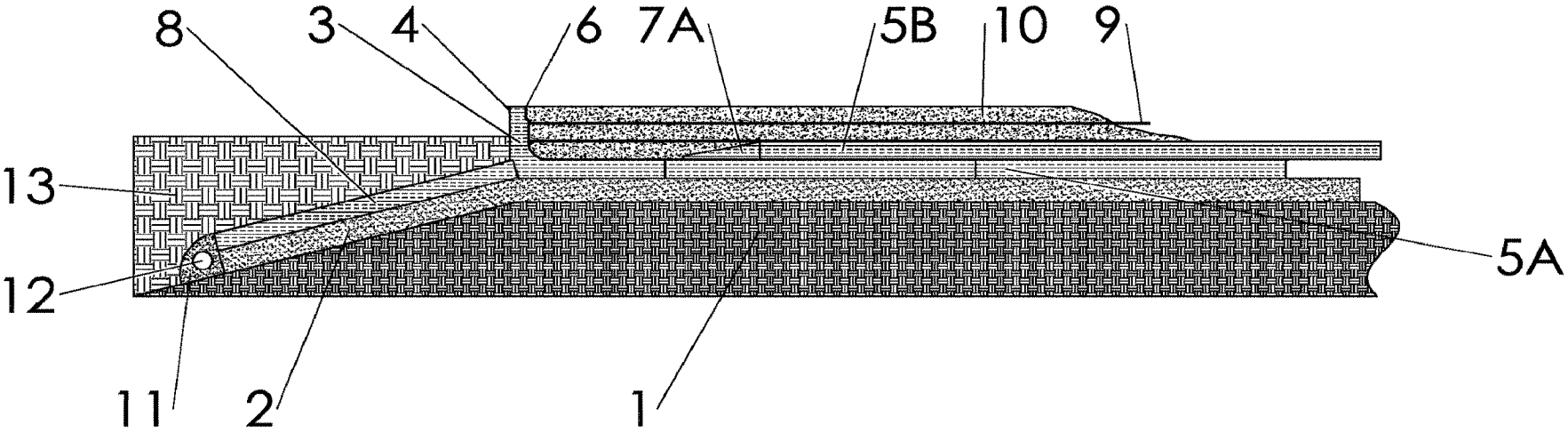
FIG. 1 is a side section view of an insulated slab-on-grade foundation system, in accordance with an illustrative embodiment of the present invention.

Referring to FIG. 1, there is schematically shown an embodiment of an insulated slab-on-grade foundation system, in accordance with a preferred embodiment of the present invention. The system is preferably installed on a natural soil layer 1 without humus. The soil layer 1 is excavated or arranged so that one portion thereof has a horizontal soil surface and another portion thereof has slanted soil surface. On top of the soil layer 1, there is disposed a layer of net gravel 2 for draining purposes. The gravel layer 2 is arranged so as to follow the profile of the soil layer 1 with one portion thereof having a horizontal gravel surface and another portion thereof having slanted gravel surface. On top of the gravel layer 2, there is disposed a modular slab 3. The modular slab 3 includes a peripheral vertical edge portion 4 made of metal for surrounding and holding different modules around the perimeter of the modular slab 3. The modular slab 3 includes a first isolating portion 5A made of rigid EPS (expanded polystyrene material) disposed along the internal surface of the modular slab 3. A vapor barrier 6 may be installed on top of the second isolating portion 5A. The modular slab 3 includes a second isolating portion 5B made of rigid EPS (expanded polystyrene material) disposed on top of the first isolating portion 5A along the internal surface of the modular slab 3. The second isolation portion 5B includes a slanted transitional portion 7A. The modular slab 3 may also include an external skirt portion 8 that extends outwardly and is disposed on top of the slanted gravel surface. Concrete 10 is poured into the modular slab 3 and rebars or reinforced bars 9 are installed in the concrete 10. At the bottom of the slanted gravel portion there is a drain 12 surrounded by gravel 11. On top of the skirt portion 8 there is a layer of filling and soil 13 for finishing the outer surroundings of the modular slab 3.

Figure 2:
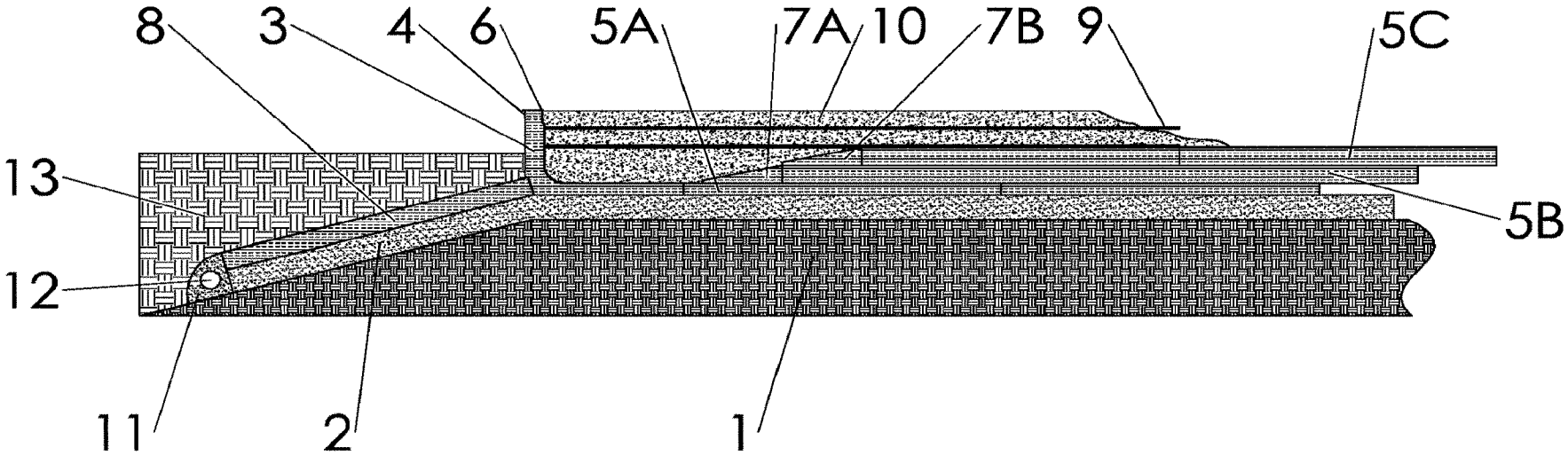
FIG. 2 is a side section view of an insulated slab-on-grade foundation system, in accordance with a second illustrative embodiment of the present invention.

Referring to FIG. 2, there is schematically shown another embodiment of an insulated slab-on-grade foundation system, in accordance with second preferred embodiment of the present invention. It is similar to the one shown in FIG. 1 and the same reference numbers refer to the same elements. In this second embodiment, the modular slab 3 includes a third isolating portion 5C made of rigid EPS (expanded polystyrene material) disposed on top of the second isolating portion 5B along the internal surface of the modular slab 3. The third isolation portion 5C includes a second slanted transitional portion 7B.

Figure 3:
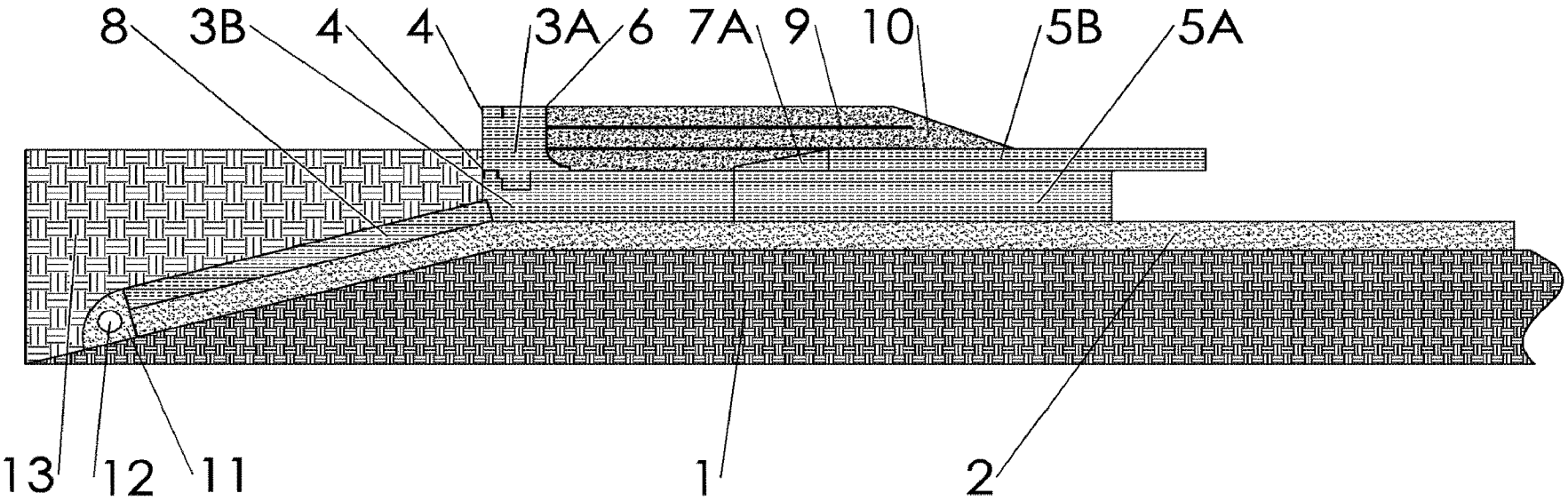
FIG. 3 is a side section view of an insulated slab-on-grade foundation system, in accordance with a third illustrative embodiment of the present invention.

Referring to FIG. 3, there is schematically shown another embodiment of an insulated slab-on-grade foundation system, in accordance with third preferred embodiment of the present invention. It is similar to the one shown in FIGS. 1-2 and the same reference numbers refer to the same elements. A modular slab 3A of different shape as the one of FIG. 1 is used.

Figure 4:
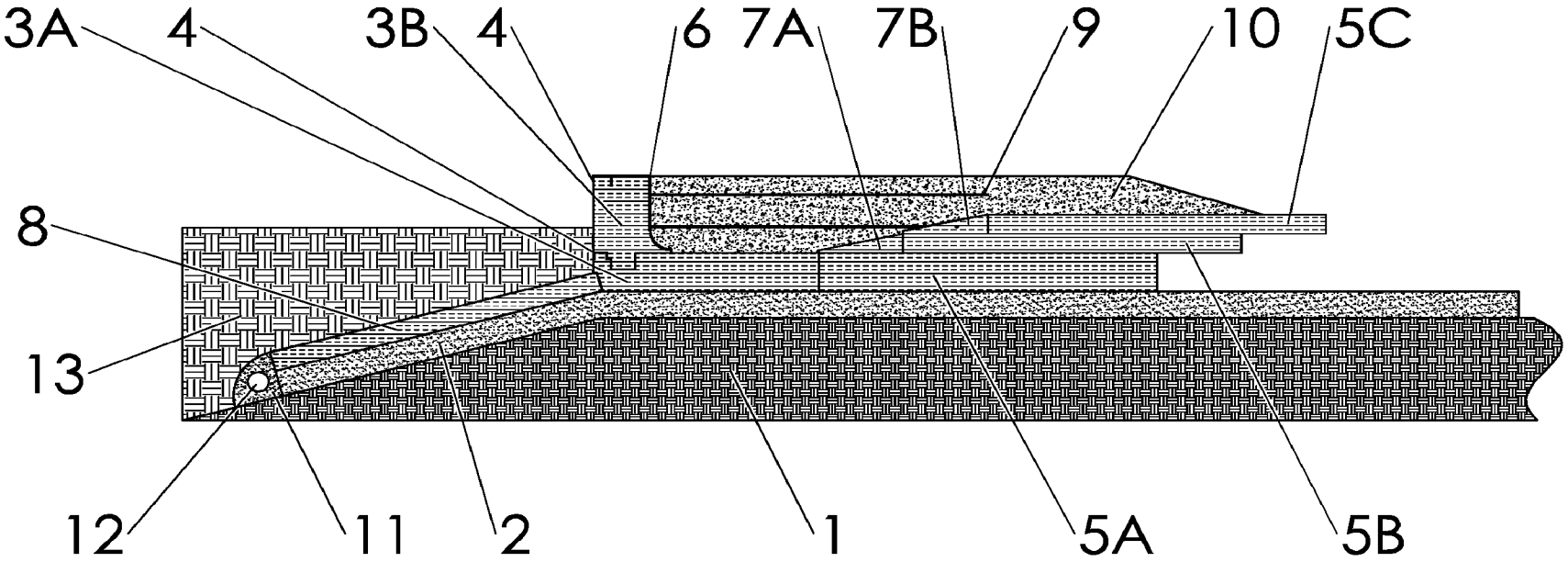
FIG. 4 is a side section view of an insulated slab-on-grade foundation system, in accordance with a fourth illustrative embodiment of the present invention.

Referring to FIG. 4, there is schematically shown another embodiment of an insulated slab-on-grade foundation system, in accordance with fourth preferred embodiment of the present invention. It is similar to the one shown in FIGS. 1-3 and the same reference numbers refer to the same elements. A modular slab 3B of different shape as the one of FIGS. 1-2 is used.

Preferably, the components of the modular slab 3, 3A or 3B are prepared in the workshop according to the size and the customer's plan.

Then, one has to prepare the ground before installing the modular slab 3, 3A or 3B. In a first step, one has to remove the top soil or vegetal part of the ground where the modular slabs 3, 3A or 3B are to be installed. One has then to arrange a gravel layer of thickness of preferably about 4 inches to 6 inches so has to provide a suitable drainage. Between the soil layer 1 and gravel layer 2 there may be a geotexile fabric so as to not lose the gravel.

Then, one determines the four corners where the modular slab 3, 3A or 3B are to be installed. A preferred length size of a modular slab 3 made of EPS is about 4 feet. One then completes with the other modules made of EPS all around the periphery.

The internal corners are made by crossing cross of two modules 3 (and/or 3*a* shown in FIG. 3) right with 8 inches extending beyond of one of the two segments on the perimeter. A flat panel fills this internal junction to achieve a 90 degrees internal corner.

One then installs a mechanical link, such as a U-shaped metal plate 4 (1⅝ inches wide) that connects all modules 3 throughout the perimeter thereof 3*b*. Each U-shape metal plate 4 of may be superimposed and secured by self-taping screws.

The inner surface of the perimeter modules 3 (an/or 3*a*) are filled with EPS that is to say the first row insulating panels 5 are installed.

The assembly of the second part of the top modular part 3*b* (module a (3*b*) made of EPS—length of 8 feet) is joined by a junction in a key way—Two modules (3*b*) cut 45 degrees in pairs make the outer corners. The perimeter segments must be completed with right modules (modular part A (3*b*) in EPS-length of 8 feet).

One then installs a mechanical link, such as a U-shaped edge portion 4*b* that is made of metal (2½" wide) that will make the joint on all modules throughout the perimeter of modules A 3*b*. Each U-shaped portion 4*b* of metal is joined by overlay and secured by self-tapping metal screws.

The junction of the modules A 3*a* and B 3*b* is done by the key path which allows an adjustment of the final level of the perimeter of the reference modules for the pouring of the concrete.

This adjustment of the keyway between the module A and B may be fixed by insulated spray in a can.

A vapor barrier 6, which is preferably of a minimum 0.39 inch (10 mm), is installed within the entire project area. All attached to the U-shaped metal portion 4 so as to perform jointing of the modules.

The next step involves installation of a transition module (½"-3"×12" length of 8') inside MODULE A (at a distance of 24" from the internal top of module A) this module is parallel (24" internal distance) from module A of the project.

The new inner surface of the transition module is filled with EPS-second row insulation board.

Some installations require a second transition module after the second row EPS insulation, if it is the case then a third row of insulation made of EPS may be required.

An EPS insulation board fits into the outer bottom of module B at the outer perimeter to make a frost protection skirt over the entire outer perimeter. (The dimensions of this EPS panel are based on the ground freeze calculation for the project region).

Although the present invention has been described hereinabove by way of specific embodiments thereof, it can be modified, without departing from the spirit and nature of the subject invention defined in the appended claims.

The invention claimed is:

1. A method of installing an insulated slab-on-grade foundation system for supporting a foundation, the method comprising:

a) locating a gravel layer on top of a soil layer to define a substantially horizontal profile and a substantially slanted profile, the substantially slanted profile being located adjacent the substantially horizontal profile;

b) forming a modular slab perimeter by locating a plurality of adjacent modular slabs which are supported by the gravel layer in the substantially horizontal profile and adjacent the substantially slanted profile, each one of the plurality of adjacent modular slabs defining an outer surface and an inner surface, the modular slabs having a base portion is supported by the gravel layer in the substantially horizontal profile, the base portion defining an outer end and an inner end; a wall portion upwardly and substantially perpendicularly extends from the base portion at the outer end, the wall portion defining a lower end and an upper end; a longitudinal groove is formed within the outer end of the base portion and at the outer surface of the modular slab; an edge portion is mounted along the upper ends of the wall portions connecting at least two adjacent modular slabs of the plurality of modular slabs together, and a peripheral skirt portion is supported by the gravel layer in the substantially slanted profile, the peripheral skirt portion defining a connection end inserted within the longitudinal groove; and c) locating at least one isolating slab layer to be supported by and cover the substantially horizontal profile found inside the modular slab perimeter, the plurality of adjacent modular slabs and the isolating slab layer together forming a receptacle for receiving poured concrete therein, the insulated slab-on-grade foundation system being supported by the gravel layer.

2. The method according to claim 1, wherein the plurality of adjacent modular slabs, the isolating slab layer and the peripheral skirt portion are made of an expanded polystyrene material.

3. The method according to claim 1, further comprising installing a plurality of reinforced bars supported over the isolating slab layer and within the receptacle allowing poured concrete to flow around the plurality of reinforced bars.

4. The method according to claim 1, further comprising installing a vapor barrier to cover the isolating slab layer and the edge portions found at the upper end of the wall portion.

5. The method according to claim 1, in which the peripheral skirt portion comprises a plurality of adjacent peripheral skirt portions extending away from the receptacle.

6. The method according to claim 1, in which each one of the plurality of adjacent modular slabs is integrally formed.

7. The method according to claim 1, wherein the wall portion is releasably mounted on the base portion.

8. The method according to claim 1, in which the wall portion comprises a connexion at the lower end thereof and further wherein the base portion comprises a corresponding connection about the outer end thereof releasably connected with the connexion.

9. The method according to claim 1, in which the isolating slab layer comprises: a first isolating layer supported by and covering the substantially horizontal profile found inside the modular slab perimeter; and a second isolating layer supported by and covering partially the first isolating layer.

10. The method according to claim 9, further comprising a first slanted transitional portion supported by the first isolating layer and adjacent the second isolating layer.

11. The method according to claim 9, further comprising a third isolating layer supported by and covering partially the second isolating layer.

12. The method according to claim 11, further comprising a second slanted transitional portion supported by the second isolating layer and adjacent the third isolating layer.

13. The method according to claim 12, in which: the first isolating layer comprises a plurality of adjacent first isolating portions; the second isolating layer comprises a plurality of adjacent second isolating portions; the third isolating layer comprises a plurality of adjacent third isolating portions; the first slanted transitional portion comprises a plurality of adjacent first slanted transitional portions; and the first slanted transitional portion comprises a plurality of adjacent first slanted transitional portions.

* * * * *